United States Patent [19]

Benoit

[11] 4,286,312

[45] Aug. 25, 1981

[54] PORTABLE LIGHTING APPARATUS COMPRISING A DIFFUSING LENS

[75] Inventor: Raymond A. Benoit, Septeuil, France

[73] Assignee: Societe les Piles Wonder, France

[21] Appl. No.: 72,651

[22] Filed: Sep. 5, 1979

[30] Foreign Application Priority Data

Oct. 17, 1978 [FR] France ..... 78 29572

[51] Int. Cl.[3] ..... F21V 7/00

[52] U.S. Cl. ..... 362/309; 362/332

[58] Field of Search ..... 362/309, 332

[56] References Cited

U.S. PATENT DOCUMENTS

| | | | |
|---|---|---|---|
| 1,486,720 | 3/1924 | Bausch et al. | 362/333 |
| 1,489,697 | 4/1924 | Carson | 362/333 |
| 1,745,278 | 1/1930 | Sisson | 362/333 |

*Primary Examiner*—Stephen J. Lechert, Jr.

*Attorney, Agent, or Firm*—Roylance, Abrams, Berdo & Farley

[57] ABSTRACT

This portable lighting apparatus which comprises a case having a parabolic reflector, a bulb whose filament is situated substantially at the focus of the parabolic reflector and a square or rectangular shaped diffusing lens fixed at the periphery of the reflector, perpendicularly to the optical axis thereof, is characterized in that the lens carries a series of rectilinear and adjacent scores on each of its internal and external faces, in that the scores of the same series are formed by concave cylindrical surfaces having transversely the same radius and are perpendicular to those of the other series and in that the radii of the scores of the internal face of the lens are slightly smaller than those of the scores of the external face of said lens, the depth and the radii of the two series of scores being chosen so that the pyramidal light beam therefrom gives constant illumination in any plane perpendicular to the optical axis.

5 Claims, 6 Drawing Figures

PORTABLE LIGHTING APPARATUS COMPRISING A DIFFUSING LENS

The present invention concerns a portable lighting apparatus comprising a case having a parabolic reflector, a bulb whose filament is situated substantially at the focus of the parabolic reflector and a square or rectangular shaped diffusing lens fixed at the periphery of the reflector, perpendicular to the optical axis thereof.

Since the light beam emitted by lighting apparatus of this type is of relatively low strength, constructors try to concentrate it along as narrow a solid angle as possible so that the user may see in acceptable conditions objects situated at a distance from him. The solution which is at present proposed to obtain satisfactory lighting consists in adapting on the portable apparatus a diffusing lens for obtaining a convergent light beam centred on the object to be observed. Experience shows however that the user, to see perfectly an object at a distance, must move his lighting apparatus by hand so that the parts of the object situated roundabout the lighted zone are swept by the light beam and become in their turn clearly visible.

When the lighting apparatus is installed on a two-wheel vehicle, e.g. on a bicycle, the difficulties resulting from the convergence of the light beam are amplified by the speed. In fact, the cyclist may clearly distinguish the loose chippings in front of the wheel of his vehicle but cannot make out at the edge of the road the obstacle which could catch the pedal and cause a fall.

The present invention aims at remedying these disadvantages and, to do this, it provides a lighting apparatus of the above-mentioned kind which is characterized in that the diffusing lens carries a series of rectilinear and adjacent scores on each of its internal and external faces, in that the scores of the same series are formed by concave cylindrical surfaces having transversely the same radius and are perpendicular to those of the other series, and in that the radii of the scores of the internal face of the lens are slightly smaller than those of the scores of the external face of said lens, the depth and the radii of the two series of scores being chosen so that the pyramidal light beam therefrom gives constant illumination in any plane perpendicular to the optical axis.

Because of the special form of the scores made on the internal and external faces of the diffusing lens, the light beam therefrom is slightly divergent so that the surface of objects which is uniformly illuminated is now greater, which thus allows objects to be more easily detected. It should be noted here that the uniform illumination of the area of the object which is exposed to the light beam is obtained because of the difference in the radii of the two series of scores. During his work, the applicant has in fact discovered that this difference of radius was essential to prevent the lighted area from being formed by a succession of light and dark zones.

Preferably, the scores of the internal face of the diffusing lens are vertical and those of the external face are horizontal. According to a first variation, the central zone of the lens is free from scores but carries concentric circular grooves. The purpose of these circular grooves is principally to mask completely the bulb and to prevent the base thereof from forming a dark zone at the centre of the diffusing lens. It contributes furthermore to removing the anomalies which appear in the zones of the light beam which are adjacent the optical axis, in particular when the filament of the bulb is not strictly at the focus of the reflector.

In a second variation, the central zone of the lens is pushed outwardly and forms a smooth circular dome which is free of scores. It will be noted here that the principal function of the circular zone is to allow the use of a so-called long bulb in the lighting apparatus.

During work effected on an electric pocket lamp comprising a parabolic reflector and a bulb whose filament placed at the focus of the reflector is at a distance of 8.5 mm from the diffusing lens, the applicant discovered that the light beam emitted gave, in a plane perpendicular to the optical axis of the reflector, non dazzling and perfectly constant illumination when, on the one hand the scores of the internal face of the lens had a radius of 4 mm and a depth of 0.6 mm and, on the other hand, the scores of the external face had a radius of 6 mm and a depth of 0.3 mm.

Two embodiments of the present invention are shown by way of example on the accompanying drawings in which.

Figure 1:
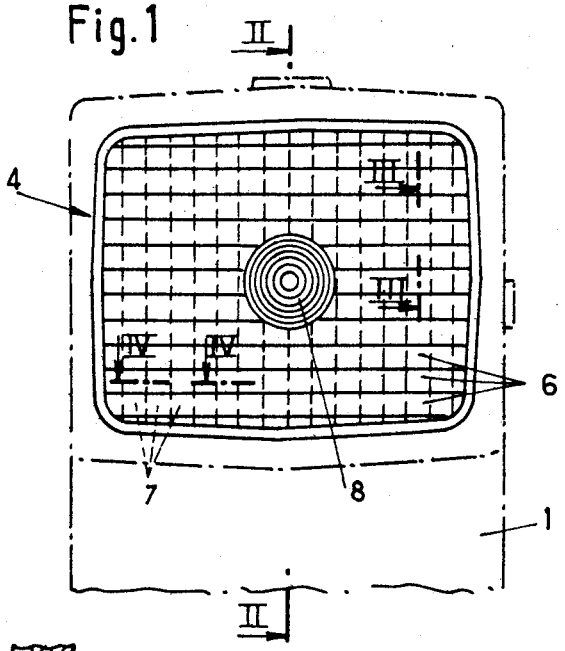
FIG. 1 is a partial front view of an electric pocket lamp comprising a diffusing lens in accordance with the invention.
Figure 2:
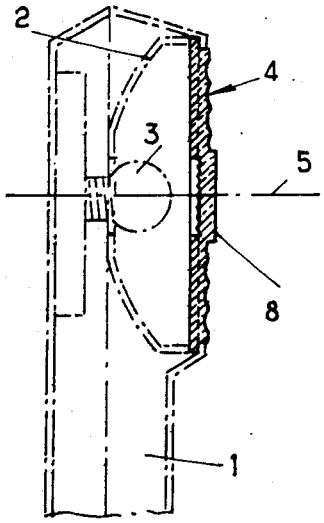
FIG. 2 is a sectional schematical view along line II-II of FIG. 1.

Referring first of all to FIGS. 1 and 2, there can be seen an electric pocket lamp 1 comprising a parabolic reflector 2, a spherical bulb 3 whose filament is situated substantially at the focus of the reflector and a diffusing lens 4, rectangular in shape, fixed at the periphery of said reflector, perpendicularly to the optical axis 5 thereof.

Case 1 is of a conventional type so that there is no need to describe it further here apart from indicating that it is made from plastic material and that it encloses in its inner part an electrical source (not shown), e.g. a battery or accumulator, connected to bulb 3 by means of an electrical circuit and a manually controlled switch (also not shown).

Diffusing lens 4 is made from a transparent material coloured or not, e.g. glass or a plastic material. It carries a series of horizontal scores 6 on its external face and a series of vertical scores 7 on its internal face.

Figure 3:
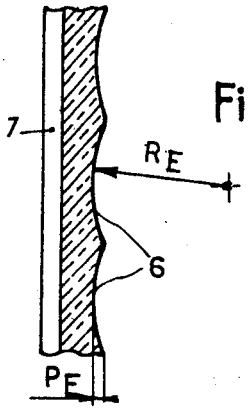
FIG. 3 is a sectional view, on a larger scale, along line III-III of FIG. 1.
Figure 4:
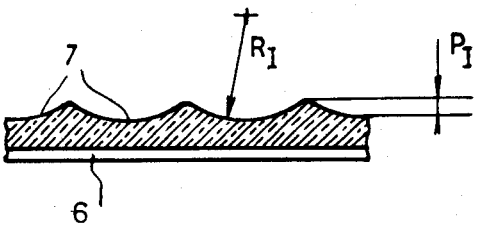
FIG. 4 is a sectional view, on a larger scale, along line IV-IV of FIG. 1.

As can be seen in FIG. 3, the horizontal scores 6 are adjacent and are in the form of concave cylindrical surfaces having transversely the same radius. Referring furthermore to FIG. 4, it will be noticed in addition that the vertical scores 7 are in their turn adjacent and that they also are in the form of concave cylindrical surfaces having the same radius.

The vertical scores have a radius which is slightly smaller than that of the horizontal scores. This difference has in fact proved necessary to prevent the light beam leaving the diffusing lens from having dark zones.

The diffusing lens shown in FIGS. 1 and 2 is free of scores in its central zone but carries in this zone a series of circular concentric grooves 8. These are in fact intended to mask further the bulb and to remove the irregularities which are created in the central part of the light beam due to the fact that the filament of the bulb is not strictly placed at the focus of the reflector.

It will be noted here that, because of their rectilinear shape, the scores 6 and 7 allow the diffusing lens to be easily cleaned and that the projecting ridges separating the scores of the same series protect the lens against scratching.

Figure 5:
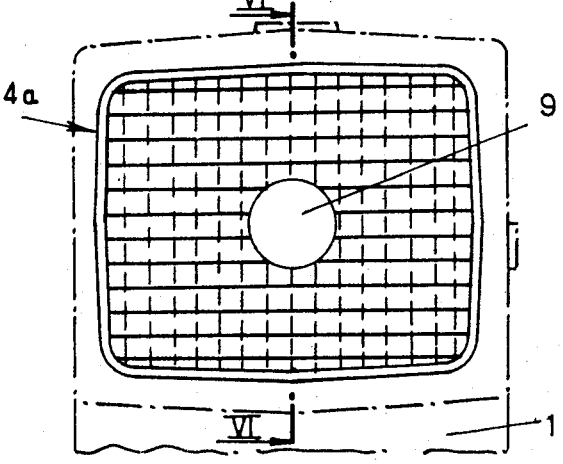
FIG. 5 is a partial view of an electric pocket lamp comprising a diffusing lens according to another embodiment.
Figure 6:
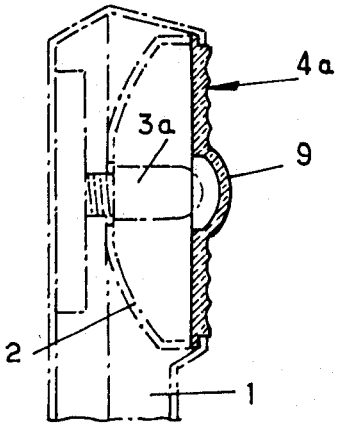
FIG. 6 is a schematical sectional view along line VI-VI of FIG. 5.

The diffusing lens 4*a* which can be seen in FIGS. 5 and 6 is distinguished from that which has just been described solely by the presence in its central zone of a circular dome 9 projecting from its external face and replacing grooves 8 mentioned above. As shown in FIG. 6 this dome allows a long bulb 3*a* to be fitted to case 1. So that the light beam leaving the diffusing lens 4 or 4*a* is slightly divergent and gives, in a plane perpendicular to the optical axis of the reflector, a non dazzling and constant illumination, the applicant has found that for an electric pocket lamp comprising a bulb whose filament was situated at 8.5 mm from the diffusing lens, it was suitable for the vertical scores to have a radius $R_1$ of 4 mm and a depth $P_I$ of 0.6 mm and for the horizontal scores to have a radius $R_E$ of 6 mm and a depth $P_E$ of 0.3 mm.

It goes without saying that the adaptation of a diffusing lens constructed in accordance with the teaching of the present invention, to the front headlamp of two-wheeled vehicles, particularly bicycles and mopeds, would provide better visibility for the users of these vehicles.

For the sake of completeness, it will be noted that by adapting a diffusing lens such as lens 4 or 4*a* to winking distress lighting apparatus, it is possible to see the light beam from any point situated in front of the plane of the lens and this because of the slight divergence of the beam emitted.

What is claimed is:

1. A portable lighting apparatus comprising a case having a parabolic reflector, a bulb whose filament is situated substantially at the focus of the parabolic reflector and a square or rectangular shaped diffusing lens fixed at the periphery of the reflector, perpendicular to the optical axis thereof and comprising a series of rectilinear and adjacent scores on each of its internal and external faces, the scores of each series being formed by concave cylindrical surfaces having the same radius of curvature, the scores of one series being substantially perpendicular to those of the other series, wherein the radii of the scores of the internal face of the lens are slightly smaller than those of the scores in the external face of said lens, and wherein the depth and the radii of the two series of scores are chosen so that the pyramidal light beam therefrom gives substantially uniform illumination in any plane perpendicular to the optical axis.

2. The portable lighting apparatus as claimed in claim 1, in which the bulb comprises a filament situated at 8.5 mm from the lens, wherein the scores of the internal face of the lens have a radius of 4 mm and a depth of 0.6 mm and those of the external face have a radius of 6 mm and a depth of 0.3 mm.

3. The portable lighting apparatus as claimed in claim 2, wherein the scores of the internal face of the diffusing lens are vertical and those of the external face thereof are horizontal.

4. The portable lighting apparatus as claimed in claim 3, wherein the central zone of the lens is free of scores but carries concentric circular grooves.

5. The portable lighting apparatus as claimed in claim 3, wherein the central zone of the lens is pushed outwardly and forms a smooth circular dome where the scores are not provided.

* * * * *